US005915991A

United States Patent [19]

Roman

[11] Patent Number: 5,915,991

[45] Date of Patent: Jun. 29, 1999

[54] LEVER TERMINAL FOR ELECTRICAL CONNECTORS

[75] Inventor: Gianfranco Roman, Pasiano, Italy

[73] Assignee: Claber S.p.A., Fiume Veneto (Pordenone), Italy

[21] Appl. No.: 08/893,365

[22] Filed: Jul. 15, 1997

[30] Foreign Application Priority Data

Jul. 25, 1996 [IT] Italy ..... MI96A1563

[51] Int. Cl.[6] ..... H01R 4/24

[52] U.S. Cl. ..... 439/441; 439/835

[58] Field of Search ..... 439/441, 439, 439/444, 727, 835

[56] References Cited

U.S. PATENT DOCUMENTS

| | | | |
|---|---|---|---|
| 2,713,668 | 6/1955 | Gibilisco | 439/441 |
| 5,110,305 | 5/1992 | Edgley et al. | 439/441 |

FOREIGN PATENT DOCUMENTS

| | | | |
|---|---|---|---|
| 0 246 199 A2 | 11/1987 | European Pat. Off. . | |
| 0335093A2 | 2/1989 | European Pat. Off. | 439/441 |
| 29 22 477 A1 | 12/1979 | Germany . | |
| 41 18 473 A1 | 3/1992 | Germany . | |
| 94 20 097 U1 | 2/1996 | Germany . | |

*Primary Examiner*—Neil Abrams
*Assistant Examiner*—Jean F. Duverne
*Attorney, Agent, or Firm*—Nixon & Vanderhye, P.C.

[57] ABSTRACT

A description is given of a terminal for electrical connectors, comprising a supporting body for a lamina spring electrically connected in a permanent way to a fixed electric circuit and elastically stressed to a position idoneous for its electrical and mechanical contact with an end of an electric cable to be connected to the aforementioned electric circuit. A lever member is rotatably linked to said supporting body and is accessible from outside so that it can be manually rotated from a rest position to a working position in which it engages with said lamina spring to move it away from said end of the electric cable.

5 Claims, 4 Drawing Sheets

LEVER TERMINAL FOR ELECTRICAL CONNECTORS

BACKGROUND

I. Field of the Invention

II. Related Art and Other Considerations

The present invention concerns a lever terminal for electrical connectors. There are various kinds of known terminals employed for electrical and mechanical connections of electrical cables with various kinds of circuitry.

The end of an electric cable, preliminarily "peeled", that is stripped of its insulating coating, is inserted into the terminal and locked therein in a condition of electrical contact, for instance with a printed circuit card.

The mechanical locking and the electrical connection are obtained in different ways, however always by means of an idoneous tool.

A known terminal for example includes a lamina spring that is in permanent contact with the electrical circuit to which the cable is to be connected and is, at the same time, elastically stressed to a position of electrical and mechanical contact with the stripped end of the electrical cable. For the shifting of the lamina spring to an unlocking position for the electrical cable, necessary for the electrical and mechanical separation of the cable as well as for the connection of the same, a screwdriver or the like is required which allows to force the spring away from the cable. The right tool is not always immediately available, and this leads to some practical problems which delay locking and unlocking of the electrical cable.

An object of the present invention is to provide a terminal for electrical cables which allows locking and unlocking of the electrical cable in an extremely simple and rapid way and without recourse to any tool.

SUMMARY

In accordance with the invention said object has been reached by a terminal comprising a supporting body for a lamina spring electrically connected in a permanent way to a fixed electric circuit and elastically stressed to a position that is idoneous for its electrical and mechanical contact with an end of an electric cable to be connected to the aforementioned electric circuit. The invention it comprises a lever member that is rotatably linked to said supporting body and is accessible from the outside thereof so that it can be manually rotated from a rest position to a working position in which it engages with said lamina spring to move it away from said end of the electrical cable.

In this way the electrical and mechanical connection of the cable is normally guaranteed by the elastic force of the spring but locking and unlocking of the cable itself is also easily obtainable by manually acting on the lever member to force the lamina spring to a suitable position for inserting the cable end in the connecting step and extracting said cable end during the disconnecting step.

BRIEF DESCRIPTION OF THE DRAWINGS

The features of the present invention will be rendered even more evident by the following detailed description of an embodiment thereof which is shown by way of a non-limitative example in the attached drawings, in which.

DETAILED DESCRIPTION OF THE DRAWINGS

Figure 1:
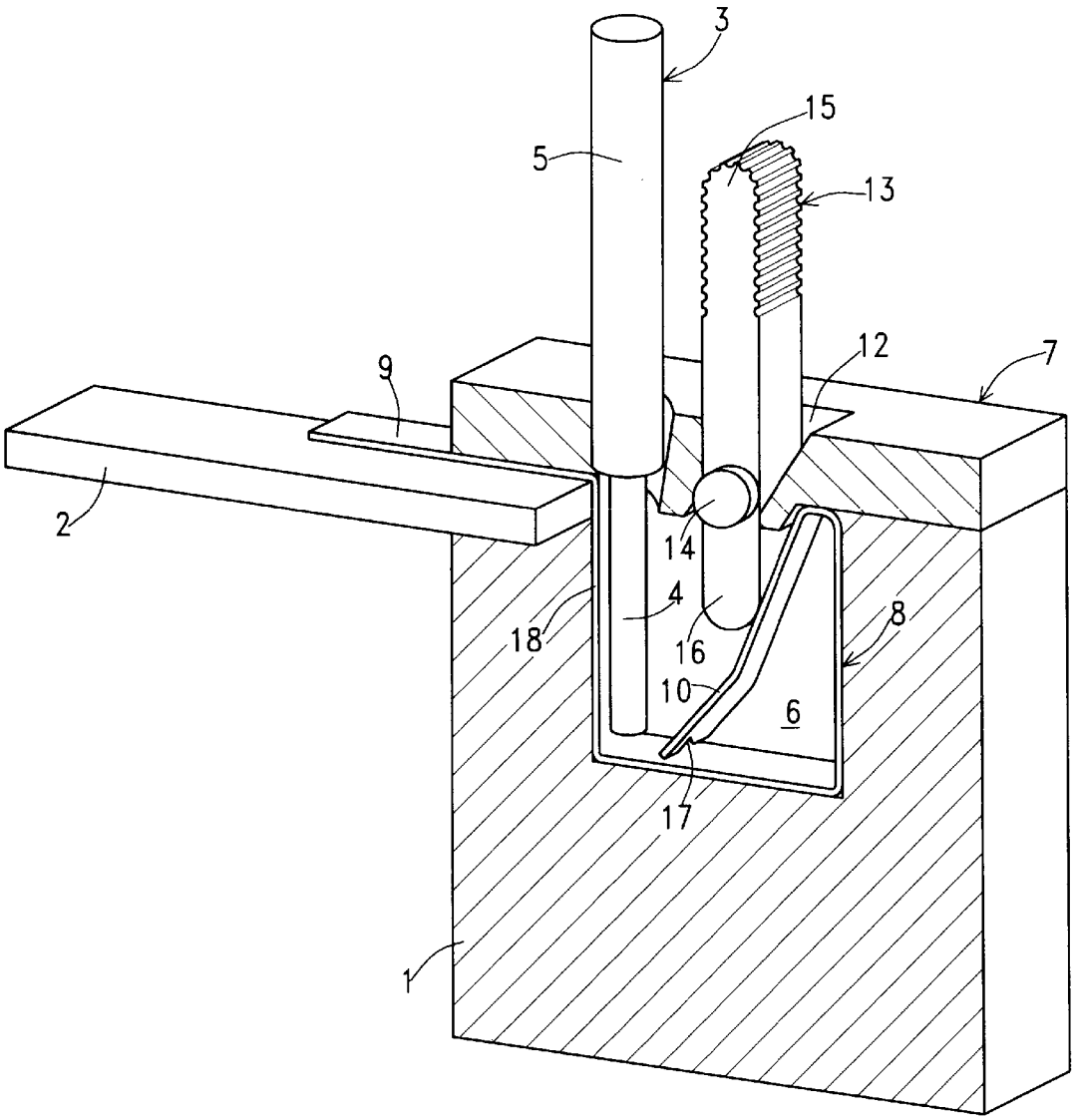
FIG. 1 shows a terminal according to the invention in perspective view in open position, that is with the electric cable in unlocked condition.

The terminal shown in the drawings comprises a supporting body 1 for a printed circuit 2, which represents the electric circuit to which an electric cable 3, with an end 4 preliminarily stripped of its insulating coating 5, must be electrically and mechanically connected or, as an alternative, from which the cable itself must be separated.

Supporting body 1 has a cavity 6, closed by a cover 7, in which the predominant part of the lamina spring 8, bent several times, is housed, having one end 9 outside of body 1, opportunely hooked up and electrically connected to the printed circuit 2.

Figure 2:
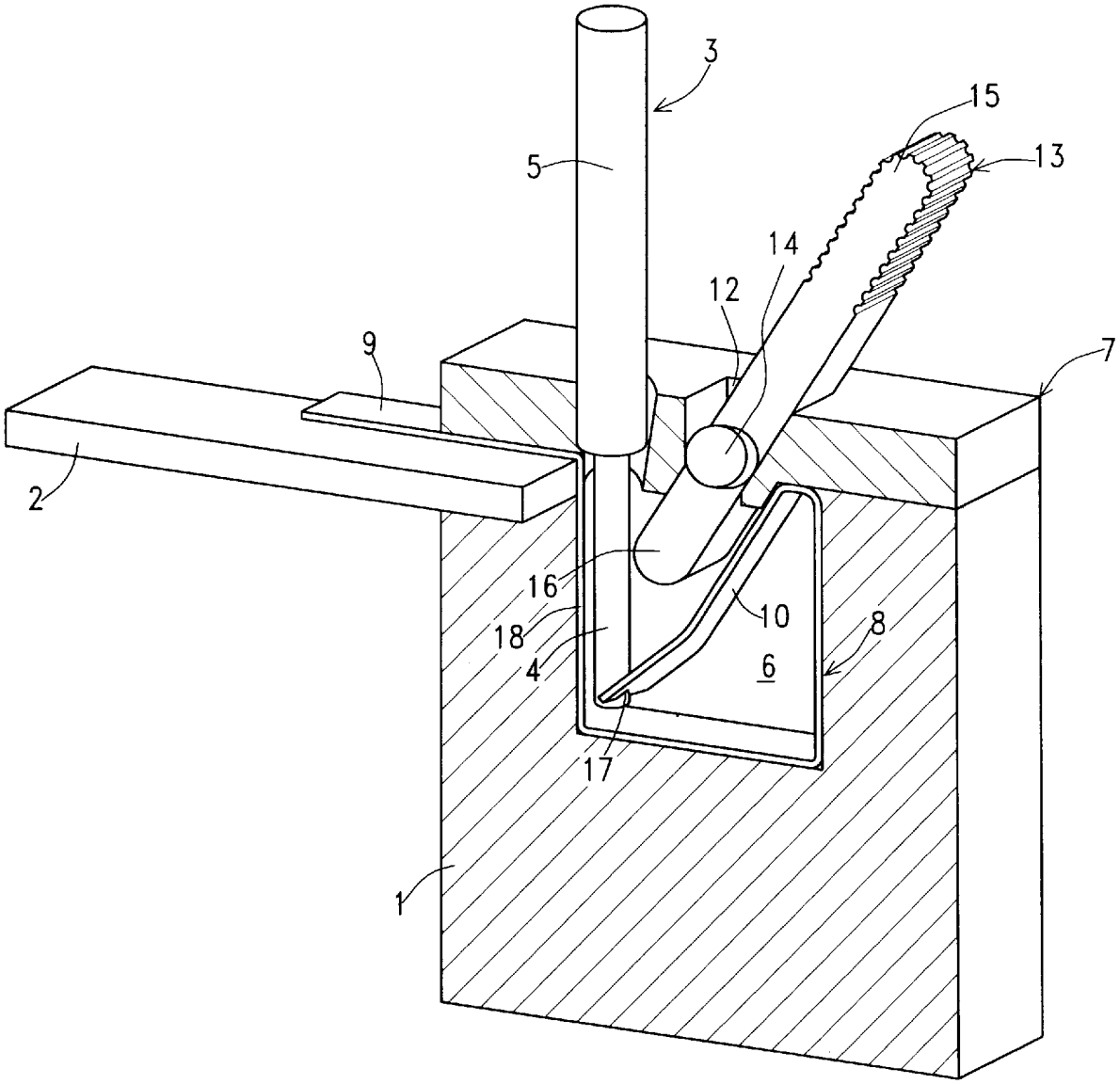
FIG. 2 shows the same terminal in another perspective view, in rest position, that is with the electric cable in locked condition.
Figure 4:
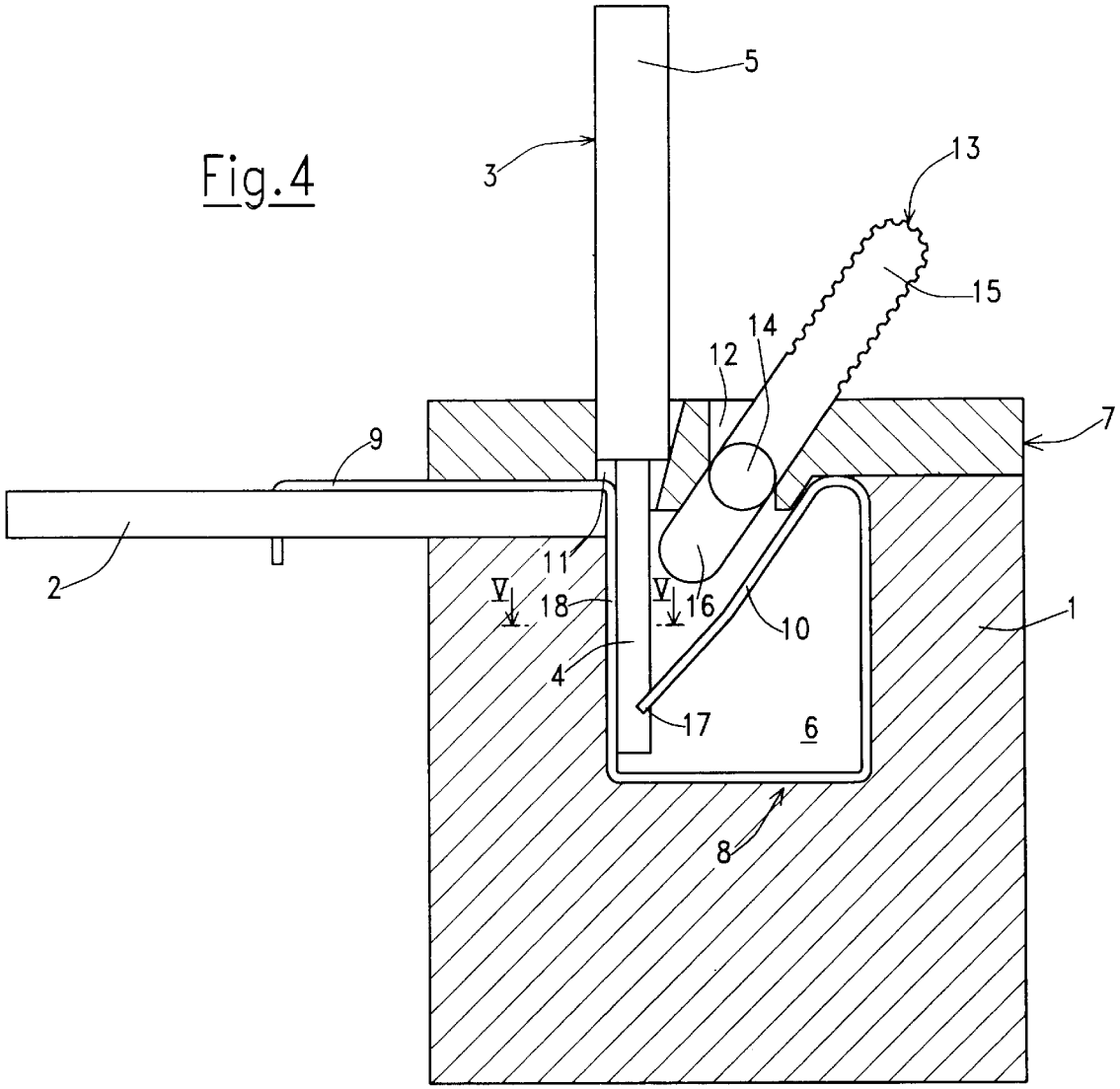
FIG. 4 shows the terminal in plane sectioned view in closed position.

Another end 10 of the lamina spring 8 is positioned obliquely and has a V-shaped face 17 elastically stressed against the stripped end 4 of the electric cable 3 when this is inserted in a cavity 6 of body 1 through a hole 11 of the cover 7, as shown in FIGS. 2 and 4.

Figure 5:
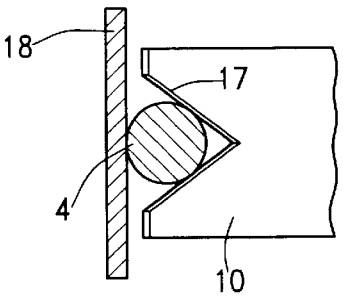
FIG. 5 shows a detail in sectioned view along to line V—V of FIG. 4.

As shown in FIG. 5, in this way there occurs an electrical and mechanical contact at three points between the aforementioned stripped end 4 of the electric cable 3 and, from one side, with the V-shaped face 17 of the lamina spring and, on the other side, a full portion 18 of the same lamina spring.

Through another hole 12 of the cover 7 passes a lever member 13, which is fulcrummed in 14 in the cover itself and has an external knurled end 15 for the purpose of manually rotating the lever member and an internal end 16 engageable or not with the oblique end 10 of the lamina spring 8 according to the position of the same lever member.

In particular, the lever member 13 is normally in the rest position of FIGS. 2 and 4 and in this position it does not exert any action on the lamina spring 8.

Figure 3:
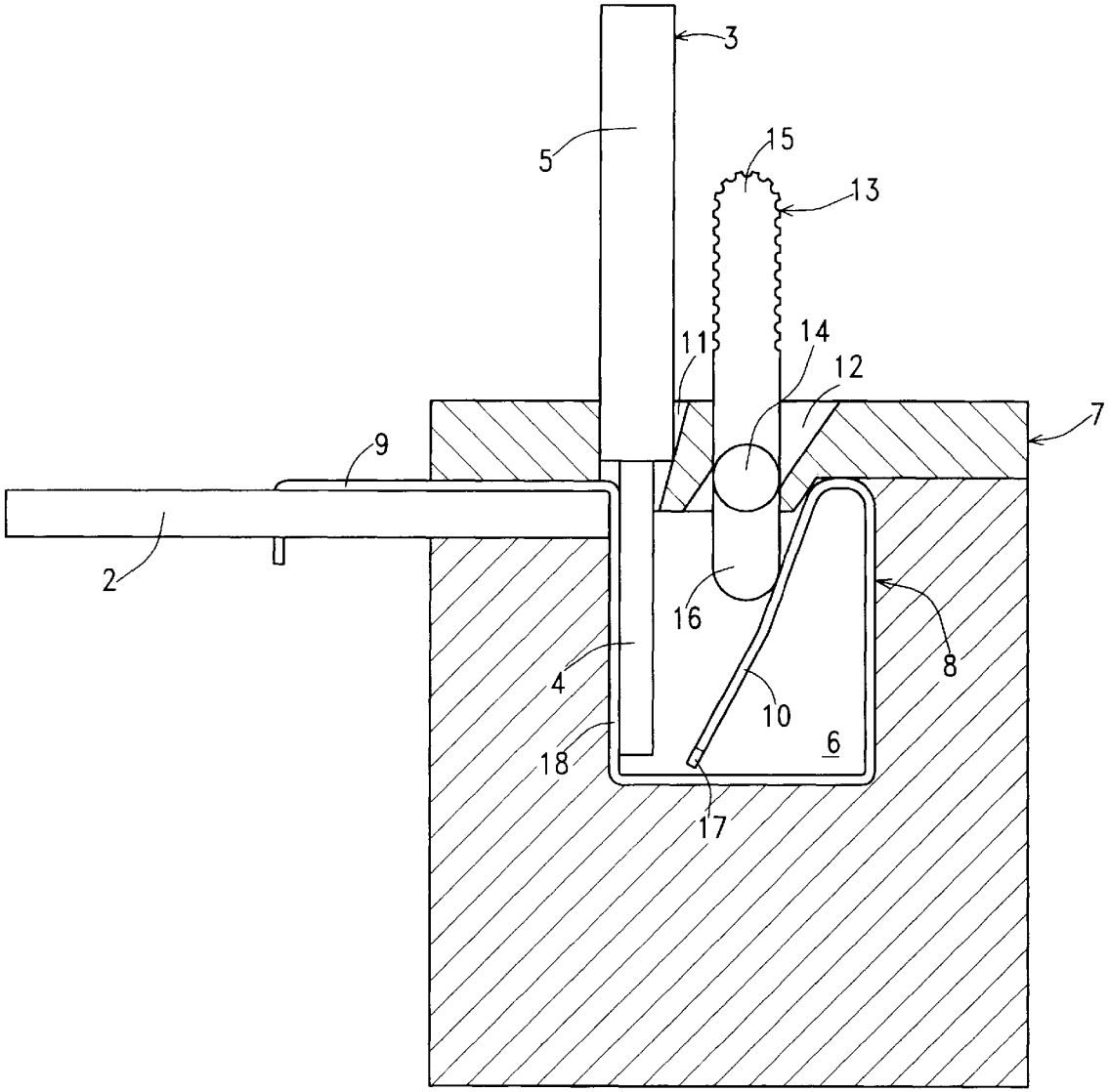
FIG. 3 shows the terminal in plane sectioned view in the open position.

The same lever member, however, can be shifted manually to the working position of FIGS. 1 and 3, in which it engages with the oblique end 10 of the lamina spring 8 to move it away from the position of mechanical locking and electrical connection of the cable 3 with the printed circuit 2. The terminal thus is in the open position and the electric cable 3 can be separated from the terminal itself or, as an alternative, an electric cable 3 can be inserted into the terminal and there mechanically locked and electrically connected to the printed circuit 2 simply by release of lever member 13 and consequent elastic return of the oblique end of the lamina spring 8 in the position engagement of the stripped end of the electric cable; the terminal in this way has returned to the closed position indicated in FIGS. 2 and 4.

I claim:

1. A terminal for electrical connectors comprising:

a hollow supporting body which defines an internal cavity in which a lamina spring is housed and electrically connected in a permanent way to a fixed external circuit;

said lamina spring having an internal oblique end elastically stressed for mechanical and electrical connection with an electric cable which is to be connected to said external circuit and which has a stripped end extending into said cavity; and a lever member which is movably linked to said supporting body and is accessible from outside said supporting body for being manually moved from a rest position in which said lever member is spaced from said lamina spring to a working position in which said lever member engages said lamina spring to force said lamina spring away from said stripped end of the electric cable.

2. The terminal of claim 1, wherein said lever member is arranged laterally adjacent said electric cable to extend substantially parallel to the electric cable when in the working position and obliquely towards the electric cable when in the rest position.

3. The terminal of claim 1, wherein said cavity of the supporting body is closed by a cover provided with a first hole for passage of said stripped end of the electric cable and with a second laterally adjacent hole for passage of said lever member.

4. The terminal of claim 4, wherein said lamina spring is configured to have plural segments, with at least two of the plural segments of the lamina spring abutting corresponding plural surfaces of the internal cavity, and wherein when the lever member is in the rest position said lamina spring has plural points of contact with said stripped end of the electric cable by virtue of at least two of the plural segments of the lamina spring being in contact with the stripped end of the electric cable.

5. The terminal of claim 4, wherein the internal cavity has a rectangular shape, and wherein the lamina spring has four segments including three segments for abutting corresponding three surfaces of the internal cavity and a fourth segment which forms the internal oblique end.

* * * * *